US007774203B2

(12) United States Patent
Wang et al.

(10) Patent No.: US 7,774,203 B2
(45) Date of Patent: Aug. 10, 2010

(54) AUDIO SIGNAL SEGMENTATION ALGORITHM

(75) Inventors: Jhing-Fa Wang, Tainan (TW); Chao-Ching Huang, Tainan (TW); Dian-Jia Wu, Tainan (TW)

(73) Assignee: National Cheng Kung University, Tainan (TW)

( * ) Notice: Subject to any disclaimer, the term of this patent is extended or adjusted under 35 U.S.C. 154(b) by 953 days.

(21) Appl. No.: 11/589,772

(22) Filed: Oct. 31, 2006

(65) Prior Publication Data

US 2007/0271093 A1 Nov. 22, 2007

(30) Foreign Application Priority Data

May 22, 2006 (TW) ..... 95118143 A

(51) Int. Cl.
*G10L 21/00* (2006.01)

(52) U.S. Cl. ..... 704/254; 704/226; 704/233

(58) Field of Classification Search ..... 704/226, 704/233, 254, 215; 381/94.2
See application file for complete search history.

(56) References Cited

U.S. PATENT DOCUMENTS

| | | | | |
|---|---|---|---|---|
| 6,415,253 | B1 * | 7/2002 | Johnson | 704/210 |
| 7,558,729 | B1 * | 7/2009 | Benyassine et al. | 704/226 |
| 2002/0161576 | A1 * | 10/2002 | Benyassine et al. | 704/229 |
| 2006/0015333 | A1 * | 1/2006 | Gao | 704/233 |

* cited by examiner

*Primary Examiner*—Daniel D Abebe
(74) *Attorney, Agent, or Firm*—Muncy, Geissler, Olds & Lowe, PLLC

(57) ABSTRACT

The present invention discloses an audio signal segmentation algorithm comprising the following steps. First, an audio signal is provided. Then, an audio activity detection (AAD) step is applied to divide the audio signal into at least one noise segment and at least one noisy audio segment. Then, an audio feature extraction step is used on the noisy audio segment to obtain multiple audio features. Then, a smoothing step is applied. Then, multiple speech frames and multiple music frames are discriminated. The speech frames and the music frames compose at least one speech segment and at least one music segment. Finally, the speech segment and the music segment are segmented from the noisy audio segment.

17 Claims, 8 Drawing Sheets

AUDIO SIGNAL SEGMENTATION ALGORITHM

RELATED APPLICATIONS

The present application is based on, and claims priority from, Taiwan Application Serial Number 95118143, filed May 22, 2006, the disclosure of which is hereby incorporated by reference herein in its entirety.

FIELD OF THE INVENTION

The present invention relates to an audio signal segmentation algorithm, and more particularly, to an audio signal segmentation algorithm used under low signal-to-noise ratio (SNR) noise environment.

BACKGROUND OF THE INVENTION

The technique of segmenting speech/music signals from audio signals has become more important in multimedia applications. There are three kinds of audio signal segmentation algorithms at present. The first kind of audio signal segmentation algorithm designs classifiers by directly extracting the features of the signals in the time domain or the frequency domain to discriminate and to further segment the speech and the music signals. The features used in these kinds of audio signal segmentation algorithms are zero-crossing information, energy, pitch, Cepstral Coefficients, line spectral frequencies, 4 Hz modulation energy and some perception features, such as tone and rhythm. These kinds of conventional techniques extract the features directly. However, the size of the windows used to analyze the signals is increasingly bigger, so the segmented scope is not precise enough. Furthermore, fixed thresholds are used in most methods to determine the segmentation. Therefore, they cannot offer satisfactory results under low SNR noise environments.

The second kind of audio signal segmentation algorithm generates features needed in the classifiers by statistics, which is called the posterior probability based feature. Although better results can be obtained by getting features with statistics, a large number of training data samples are needed in these kinds of conventional techniques and they are also not suitable in actual environments.

The third kind of audio signal segmentation algorithm emphasizes the design of the classifier models. The most commonly used methods are Bayesian information criterion, Gaussian likelihood ratio and a hidden Markov model (HMM) based classifier. These kinds of conventional techniques put stress on setting up effective classifiers. Although the methods are practical, some of them need larger computation, such as using the Bayesian information criterion, and some of them need to prepare a large number of training data samples in advance to set up the models needed, such as using Gaussian likelihood ratio and hidden Markov model (HMM). They are not good choices in practical applications.

SUMMARY OF THE INVENTION

Therefore, one objective of the present invention is to provide an audio signal segmentation algorithm suitable to be used in low SNR environments which works well in practical noisy environments.

Another objective of the present invention is to provide an audio signal segmentation algorithm which can be used in the front of the audio signal processing system to classify the signals and further to let the system discriminate and segment the speech and the audio signals.

Still another objective of the present invention is to provide an audio signal segmentation algorithm in which plenty of training data is not needed and the ability of the features chosen to resist the noise is better.

Still another objective of the present invention is to provide an audio signal segmentation algorithm which can be used as an IP to be supplied to multimedia system chips.

According to the aforementioned objectives, the present invention provides an audio signal segmentation algorithm comprising the following steps. First, an audio signal is provided. Then, an audio activity detection (AAD) step is applied to divide the audio signal into at least one first audio segment and at least one second audio segment. Then, an audio feature extraction step is performed on the second audio segment to obtain a plurality of audio features of the second audio segment. A smoothing step is then applied to the second audio segment after the audio feature extraction step. Afterwards, a plurality of speech frames and a plurality of music frames are discriminated from the second audio segment wherein the speech frames and the music frames compose at least one speech segment and at least one music segment, respectively.

According to the preferred embodiment of the present invention, the first audio segment is a noise segment. The audio activity detection step further comprises the following steps. First, the audio signal is divided into a plurality of frames. Then, a frequency transformation step is applied to signals in each of the frames to obtain a plurality of bands in each frame. Then, a likelihood computation step is performed on the bands and a noise parameter to obtain a likelihood ratio there between. Then, a comparison step is performed on the likelihood ratio and a noise threshold. If the noise threshold is greater than the likelihood ratio, the bands belong to a first frame, and if the likelihood ratio is greater than the noise threshold, the bands belong to a second frame wherein the first frame belongs to the first audio segment and the second frame belongs to the second audio segment. When a distance between two adjacent second frames is smaller than a predetermined value, the two adjacent second frames are combined to compose the second audio segment.

According to the preferred embodiment of the present invention, the frequency transformation step is a Fourier Transform. The noise parameter is a noise variance of the Fourier coefficient and is obtained by estimating a variance of a noise segment in the initial part of the audio signal.

According to the preferred embodiment of the present invention, the estimation of the noise threshold further comprises the following steps. First, a noise segment in initial the part of the audio signal is extracted. Then, the noise segment is mixed with one of a plurality of noiseless speech/music segment to a predetermined signal-to-noise ratio (SNR) to form a mixing audio segment. Then, the audio activity detection step is applied to the mixing audio segment to divide the mixing audio segment into at least one speech segment and at least one music segment by using a first threshold. Afterwards, the algorithm judges if the speech segment and the music segment match the noiseless speech/music segment and obtain a result. If the result is yes, the first threshold is equal to the noise threshold. If the result is no, the first threshold is adjusted and the audio activity detection step and the judging step are repeated on the mixing audio segment. In the preferred embodiment of the present invention, the present invention further comprises mixing the noise segment and the other noiseless speech/music segments, respectively, and repeating the audio activity detection step and the judging step to obtain a plurality of thresholds, and then, comparing the thresholds with the first threshold to choose a smallest value as the noise threshold.

According to the preferred embodiment of the present invention, the audio features are selected from the group consisting of low short time energy rate (LSTER), spectrum flux (SF), likelihood ratio crossing rate (LRCR) and an arbitrary combination thereof. The audio feature extraction step to extract the audio feature of likelihood ratio crossing rate further comprises computing a sum of a crossing rate of the waveform of the likelihood ratio to a plurality of predetermined thresholds by using the likelihood ratio of each frame. If the sum of the crossing rate is greater than a predetermined value, the likelihood ratio belongs to the speech segment, and if the sum of the crossing rate is smaller than the predetermined value, the likelihood ratio belongs to the music segment. In the preferred embodiment of the present invention, one of the predetermined thresholds is one third the mean of the likelihood ratio, and another one of the predetermined thresholds is one ninth the mean of the likelihood ratio.

According to the preferred embodiment of the present invention, the smoothing step further comprises performing a convolution process to the second audio segment after the audio feature extraction step and a window. The window may be a rectangular window. The step of discriminating the speech frames and the music frames from the second audio segment is based on a classifier, and the classifier is selected from the group consisting of a K-nearest neighbor (KNN) classifier, a Gaussian mixture model (GMM) classifier, a hidden Markov model (HMM) classifier and a multi-layer perceptron (MLP) classifier. After discriminating the speech frames and the music frames from the second audio segment, the speech frames and the music frames are respectively combined to form the speech segment and the music segment. The preferred embodiment of the present invention further comprises segmenting the speech segment and the music segment from the second audio segment.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The present invention discloses an audio signal segmentation algorithm comprising the following steps. First, an audio signal is provided. Then, an audio activity detection (AAD) step is applied to divide the audio signal into at least one noise segment and at least one noisy audio segment. Then, multiple audio features are extracted from the noisy audio segment by a frame with fixed length in the audio feature extraction step. Afterwards, a smoothing step is applied to the audio features to raise the discrimination rate of the speech and the music frames. Then, a classifier is used to tell the speech and the music frames apart. Finally, the frames of the same kind are merged according to the result and the speech and the music segments are then segmented.

In order to make the illustration of the present invention more explicit and complete, the following description is stated with reference to FIGS. 1 through 8.

Figure 1:
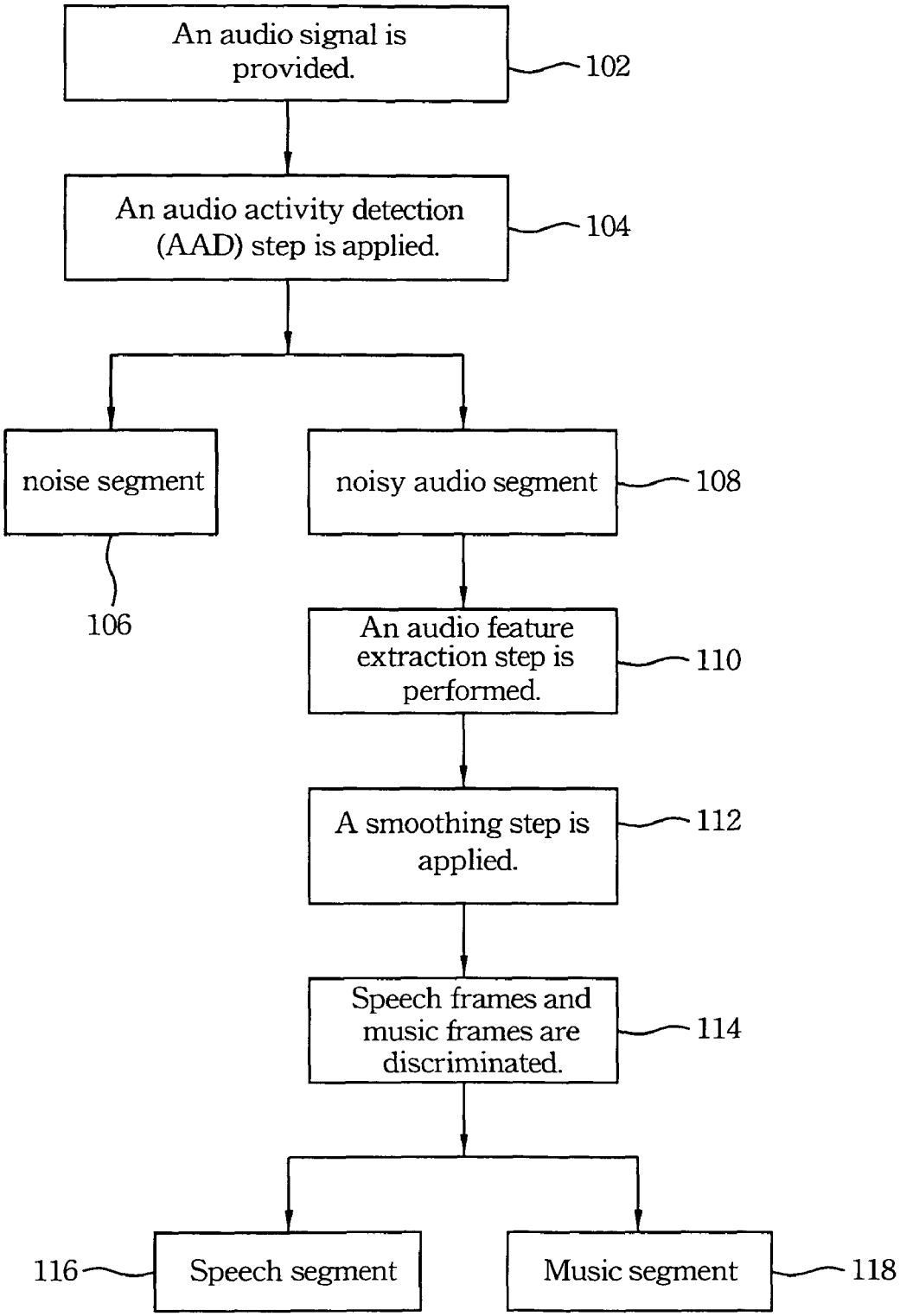
FIG. 1 illustrates a flow diagram of the audio signal segmentation algorithm according to the preferred embodiment of the present invention.

Refer to FIG. 1. FIG. 1 illustrates a flow diagram of the audio signal segmentation algorithm according to the preferred embodiment of the present invention. First, an audio signal is provided in step 102. Then, an audio activity detection (AAD) step is applied to divide the audio signal into a noise segment 106 and a noisy audio segment 108 in step 104. Then, an audio feature extraction step is performed on the noisy audio segment 108, as shown in step 110. In the preferred embodiment of the present invention, the audio feature extraction step extracts three kinds of audio features from the noisy audio segment 108. The audio features are low short time energy rate (LSTER), spectrum flux (SF), and likelihood ratio crossing rate (LRCR), respectively. The likelihood ratio of each frame is used to compute the sum of the crossing rate in the waveform of the likelihood ratio compared to multiple predetermined thresholds. If the sum of the crossing rate is greater than a predetermined value, the likelihood ratio belongs to a speech segment, and if the sum of the crossing rate is smaller than the predetermined value, the likelihood ratio belongs to a music segment.

Then, in step 112, a convolution process is performed on the result obtained and a window (such as a rectangular window) in the smoothing step to raise the discrimination rate for the following step. Then, in step 114, a classifier is used to tell the speech and the music frames apart. The speech frames and the music frames compose at least one speech segment and at least one music segment, respectively. Then, the frames of the same kind are merged according to the result and the speech and the music segments are then segmented. Finally, the speech segment 116 and the music segment 118 are obtained. In the preferred embodiment of the present invention, the classifier is a KNN based classifier and it classifies the signals into different types in a codebook and further determines if the signals belong to speech or music. The following describes in detail the audio activity detection step used in the preferred embodiment of the present invention.

Figure 2:
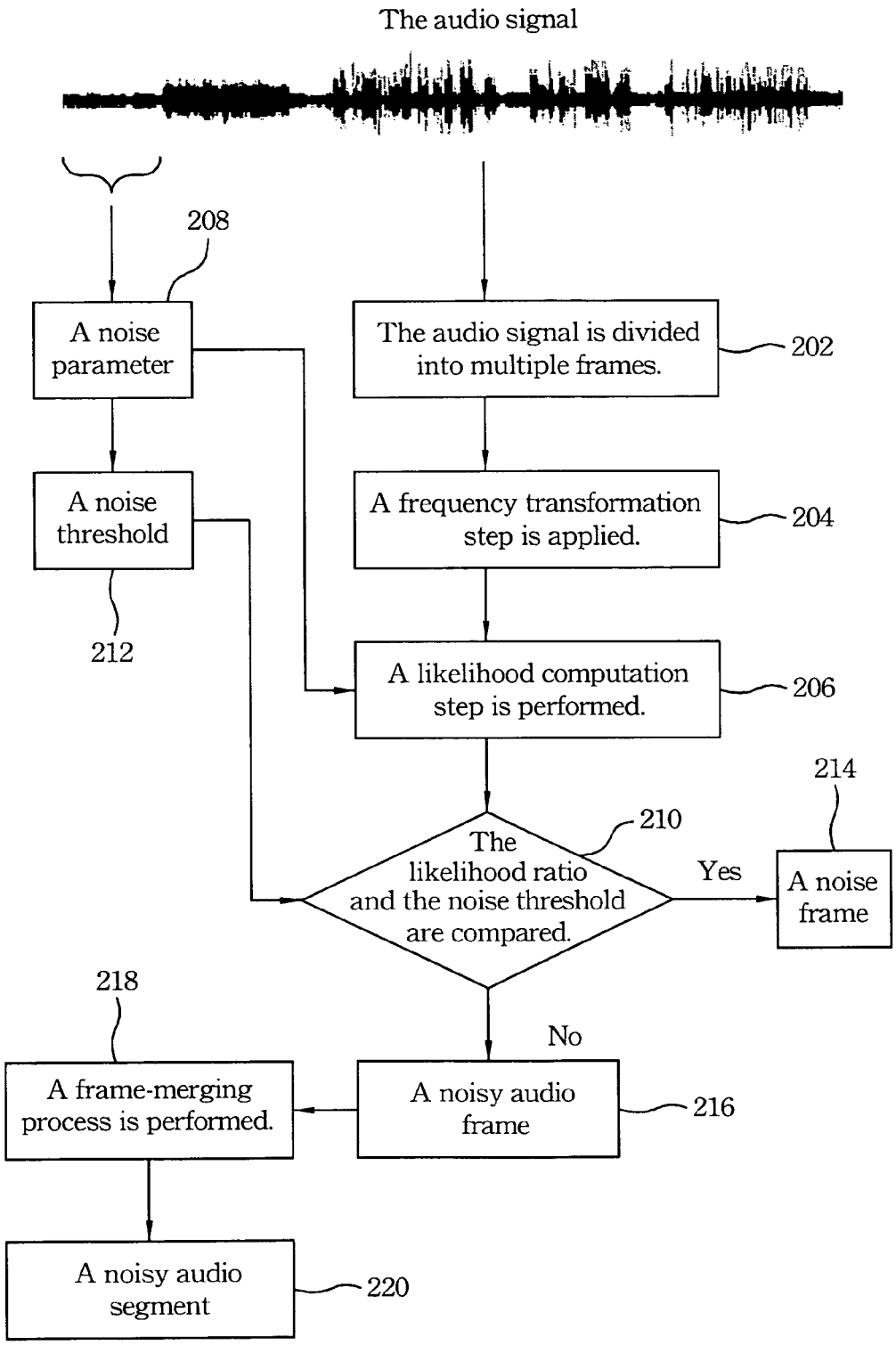
FIG. 2 illustrates a flow diagram of the audio activity detection step according to the preferred embodiment of the present invention.

Refer to FIG. 2. FIG. 2 illustrates a flow diagram of the audio activity detection step according to the preferred embodiment of the present invention. First, the audio signal is divided into multiple frames in step 202. The length of each frame may be 30 ms. Then a frequency transformation step is applied to the signals in each frame to obtain multiple bands in each frame in step 204. In the preferred embodiment of the present invention, the frequency transformation step uses a Fourier Transform. Then, a likelihood computation step is performed on the bands and a noise parameter 208 to obtain a likelihood ratio between them in step 206. The noise parameter 208 is the noise variance of the Fourier coefficient and is obtained by estimating the variance of a noise segment in the initial part of the audio signal.

Then, in step 210, a comparison step is performed between the likelihood ratio and the noise threshold 212. If the likelihood ratio is smaller than the noise threshold, the bands belong to a noise frame 214, and if the likelihood ratio is greater than the noise threshold, the bands belong to a noisy audio frame 216. In the preferred embodiment of the present invention, the likelihood computation step and the comparison step are based on the equation:

$$\Lambda = \frac{1}{L}\sum_{k=0}^{L-1}\left\{\frac{|X_k|^2}{\lambda_N(k)} - \log\frac{|X_k|^2}{\lambda_N(k)} - 1\right\} \underset{H_0}{\overset{H_1}{\gtrless}} \eta$$

where $\Lambda$ is the likelihood ratio, L is the number of the bands, $X_k$ denotes the kth Fourier coefficient in one of the frames, $\lambda_N(k)$ is the noise variance of the Fourier coefficient and denotes the variance of the kth Fourier coefficient of the noise, $\eta$ is the noise threshold, $H_0$ denotes the result is the noise frame, and $H_1$ denotes the result is the noisy audio frame.

Figure 3:
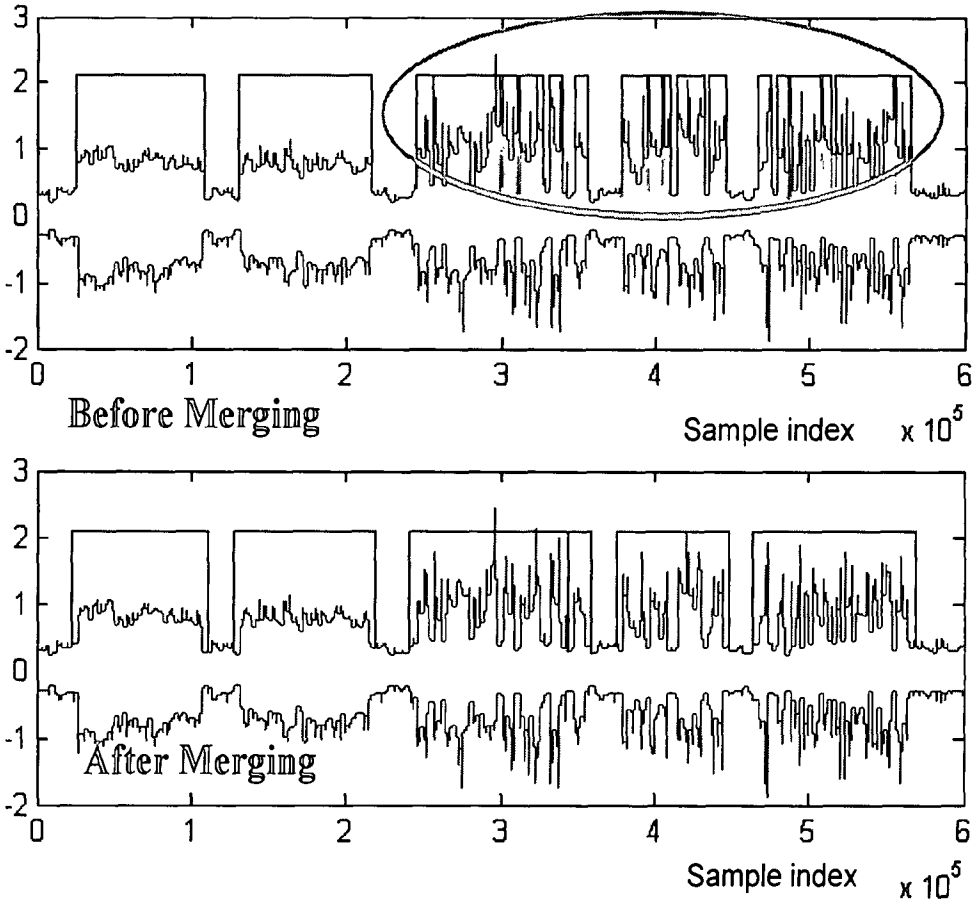
FIG. 3 illustrates an example of the frame-merging process in the preferred embodiment of the present invention.

Then, a frame-merging process is performed in step 218. Some times the too-small and discrete frames are meaningless, so the frame-merging process is used to merge the small pieces into longer segments and to further raise the discrimination accuracy afterwards. In the preferred embodiment of the present invention, the method to merge the frames is to determine if the distance between the two adjacent frames detected is too small by programming. If the distance is too small, they are considered to be merged into the same frame. If the distance is not too small, they are still considered two different frames. In other words, when the distance between two adjacent noisy audio frames is smaller than a predetermined value, the two adjacent noisy audio frames are combined to compose the noisy audio segment 220. Refer to FIG. 3. FIG. 3 illustrates an example of the frame-merging process in the preferred embodiment of the present invention. As the circle in FIG. 3 shows, when the distance between the adjacent frames is too small, they are merged into a single frame.

It is noted that the noise threshold $\eta$ can be estimated as different values according to different environments rather than a fixed value in order to make the audio signal segmentation algorithm of the present invention suitable for different environments. The following describes in detail the estimation of the noise threshold.

Figure 4:
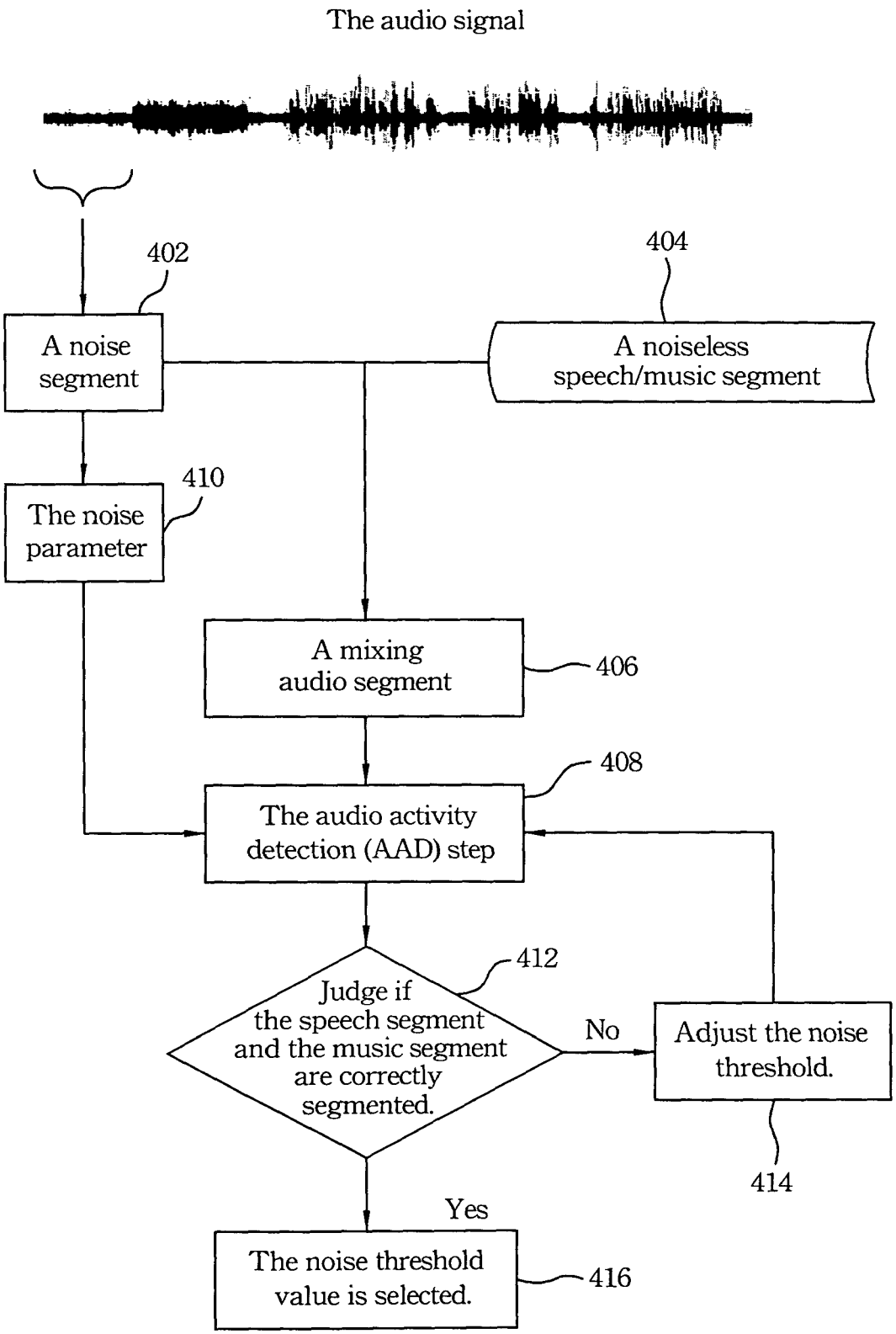
FIG. 4 illustrates a flow diagram of the estimation of the noise threshold according to the preferred embodiment of the present invention.

Refer to FIG. 4. FIG. 4 illustrates a flow diagram of the estimation of the noise threshold according to the preferred embodiment of the present invention. First, a noise segment 402 in the initial part of the audio signal is extracted. Then, the noise segment 402 is mixed with a noiseless speech/music segment 404 to a predetermined signal-to-noise ratio (SNR) to form a mixing audio segment 406. Then, the noise parameter 410 estimated from the noise segment 402 is used to perform the audio activity detection step on the mixing audio segment 406, as shown in step 408. The mixing audio segment 406 is first divided into multiple frames, and then, a frequency transformation step is applied to signals in each frame to obtain multiple bands in each frame. Then, a likelihood ratio between the bands and the noise parameter is computed, and the mixing audio segment 406 is divided into at least one speech segment and at least one music segment using a first threshold. Afterwards, in step 412, a judging step is performed to judge if the speech segment and the music segment are correctly segmented to match the noiseless speech/music segment 404 and obtain a result. If the result is no, the first threshold is adjusted and the audio activity detection step and the judging step are repeated on the mixing audio segment 406, as shown in step 414. If the result is yes, the first threshold is equal to the noise threshold, as shown in step 416.

In other words, the estimation of the noise threshold in the preferred embodiment of the present invention extracts a noise segment in initial part of the audio signal first and then mixes the noise segment with prepared training data (a noiseless speech/music segment) to a certain predetermined signal-to-noise ratio. Since the training data is prepared in advance, the location of the voice in the training data is already known, so the signal-to-noise ratio of the training data and the noise segment can be adjusted. Generally, if the signal with the lowest SNR in the system is 5 dB, the SNR of the mixing audio segment can be set to 3 dB to estimate the threshold. It just needs to be smaller than 5 dB. Then, the audio activity detection step is performed to the mixing audio segment. The mixing audio segment is proceeded a Fourier transform by a unit of 30 ms frame. Then, the likelihood ratio is computed, and an initial threshold (0) is used to judge. If the threshold can detect all of the voice part in the training data, the threshold is adjusted to be 0.2 higher until the threshold with the highest value that still can completely tell apart all the voice segments is obtained. There are t training data, so the step needs to be done for t times. However, each training data is not as long as usual, so it does not take too much time. When all training data is processed, t thresholds can be obtained and the smallest one among these t thresholds is chosen to be the threshold used in the system.

The following describes in detail the audio feature extraction step used in the preferred embodiment of the present invention.

After performing the audio activity detection step, the audio signal inputted is divided into a noise segment and a noisy audio segment. Then, the audio feature extraction step is performed on the noisy audio segment to obtain audio features of the noisy audio segment. Three audio features are used in discriminating the speech signals and the music signals in the preferred embodiment of the present invention. Each audio feature is defined in a length of about one second, and the length of one second is also the smallest unit in the discrimination in the preferred embodiment of the present invention. These three audio features are low short time energy rate (LSTER), spectrum flux (SF), and likelihood ratio crossing rate (LRCR), respectively. They are described as follows.

The audio features of the low short time energy rate: in a piece of audio signals, since the change of the energy in the frames of the speech signal is bigger than that of the music signal owing to the pitch, the speech signal and the music signal can be discriminated just by calculating the ratio of the low energy.

The audio feature of spectrum flux: in a piece of audio segment, since the energy of the speech signal is changeable, if calculating the sum of the frequency distance between the adjacent frames in the piece of audio segment, the speech signal has bigger value. The change in the frequency of the audio signal is usually slower, so the sum of the frequency distance between the adjacent frames is smaller. Therefore, the spectrum flux can be used to discriminate the speech and the music signal.

The audio feature of likelihood ratio crossing rate: The waveform of the likelihood ratio obtained in the AAD step can be used to tell the speech and the music apart by observing the damping characteristics. The speech signal has more frames of low energy than the music signal does. However, the speech and the music signal are not easily discriminated in the way of calculating the energy in time domain. Therefore, the audio feature of likelihood ratio crossing rate is derived in frequency domain. The likelihood ratio waveform of each frame obtained in the AAD step is used and the sum of the crossing rate of the likelihood ratio waveform compared to two thresholds is calculated. Generally speaking, the crossing rate in speech is higher than in music. The following describes in detail the audio feature extraction step in likelihood ratio crossing rate used in the present invention.

Figure 5:
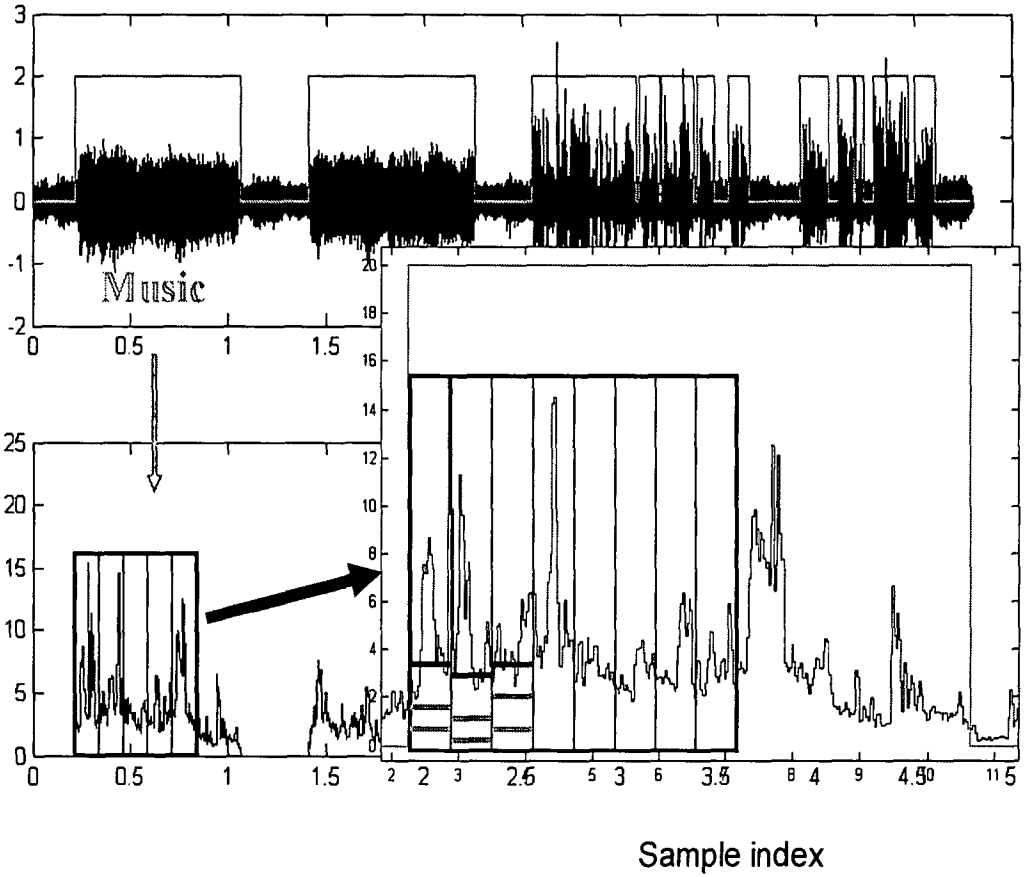
FIG. 5 illustrates a diagram of the likelihood ratio crossing rate of the music signal.
Figure 6:
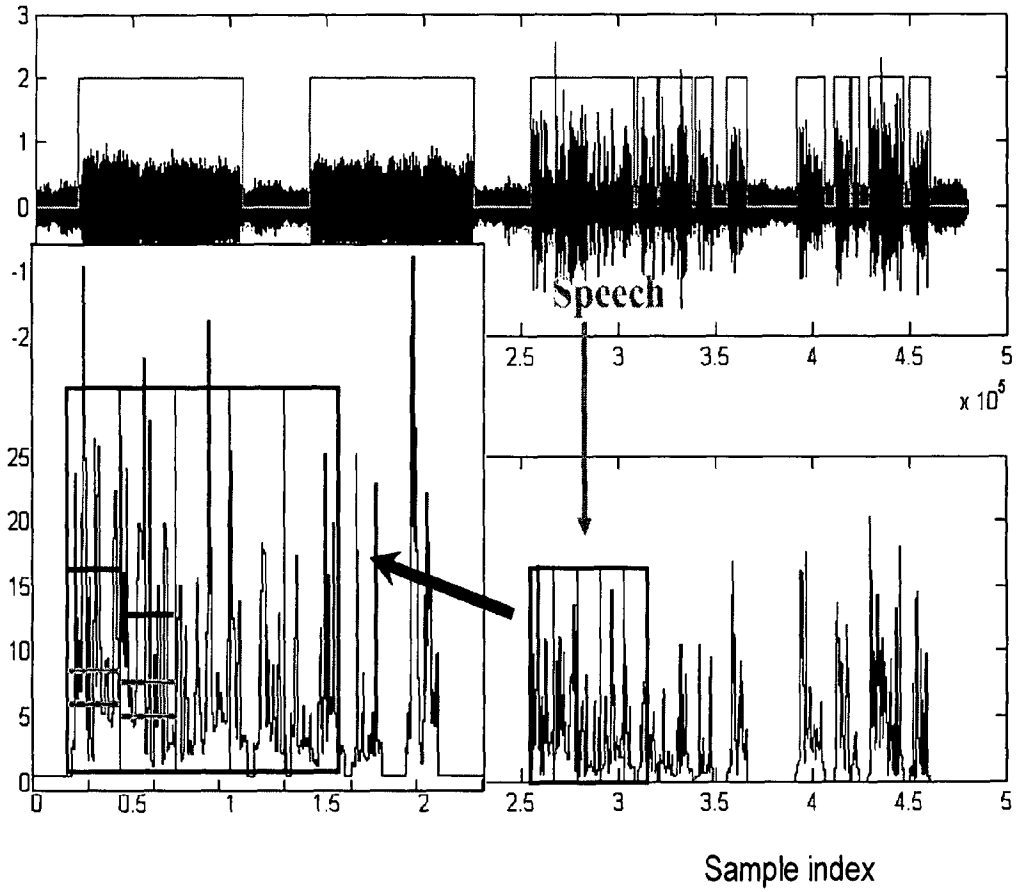
FIG. 6 illustrates a diagram of the likelihood ratio crossing rate of the speech signal.

Refer to FIG. 5 and FIG. 6. FIG. 5 and FIG. 6 illustrate diagrams of the likelihood ratio crossing rate of the music and the speech signal, respectively. As shown in the enlarged diagram in FIG. 5 and FIG. 6, one second is the smallest analyzing unit for each segment, and eight and five windows with one second in unit are illustrated, respectively. The mean and the two thresholds of the likelihood ratio in each window are computed. The mean of the likelihood ratio is denoted by the upper line, and the middle line and the lower line represent the two thresholds with one third the mean of the likelihood ratio and one ninth the mean of the likelihood ratio, respectively. Then, the sum of the crossing rate of the likelihood ratio compared to the two thresholds is computed to discriminate between the music and the speech signals. From FIG. 5 and FIG. 6, the crossing rate of the likelihood ratio to the two thresholds of the music part in FIG. 5 is smaller than that of the speech part in FIG. 6.

Figure 7:
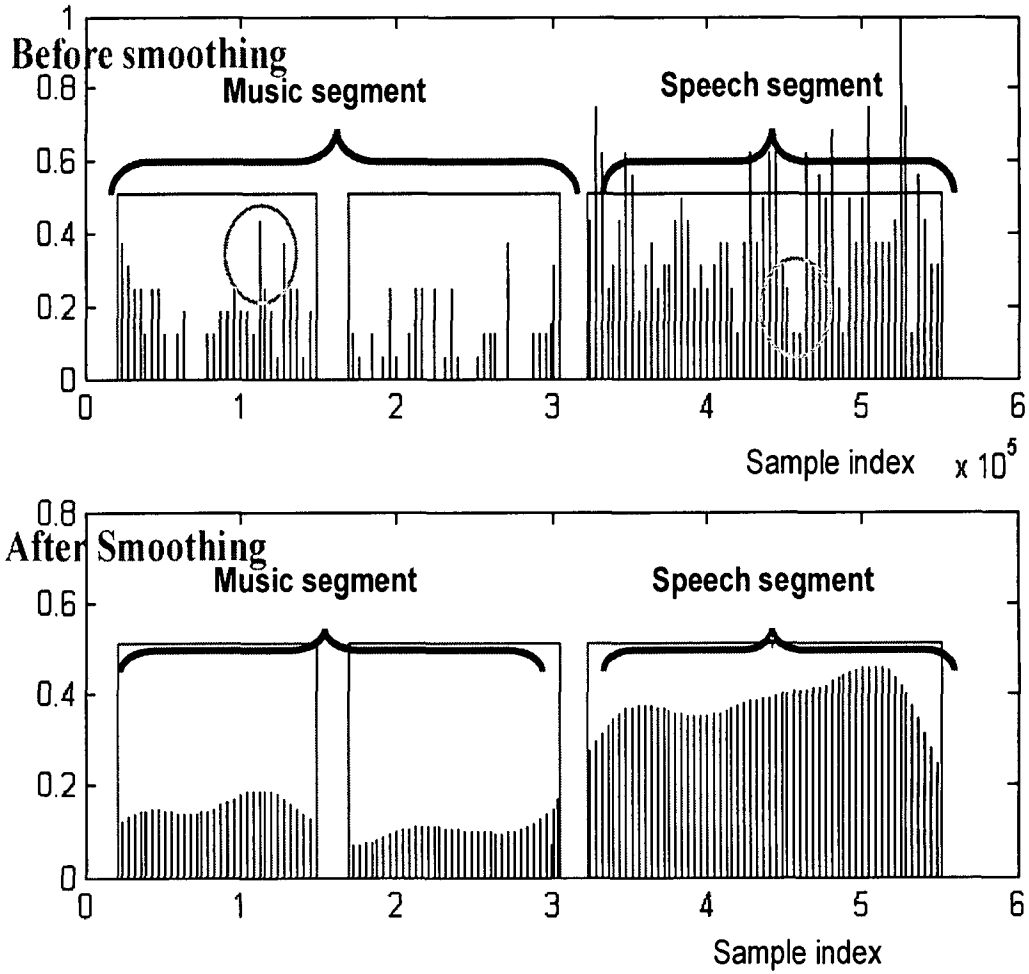
FIG. 7 illustrates an example of the smoothing step according to the preferred embodiment of the present invention.

Refer to FIG. 7. FIG. 7 illustrates an example of the smoothing step according to the preferred embodiment of the present invention. After extracting the three audio features from each segment, a smoothing step is applied to the audio features to raise the discrimination rate of the speech and the music frames. In the preferred embodiment of the present invention, a rectangular window is used to perform the convolution process on the audio feature sequences obtained. The difference between before and after the smoothing step on the waveform of the music and the speech frames is shown in FIG. 7. In the waveform before the smoothing step, the audio feature sequences are irregular. The values of the features in speech segments are supposed to be high, but some of them are not as expected. So is the music segment. The circles in FIG. 7 point out two examples of them. After the convolution process is performed with the rectangular window, it is shown that the feature sequences are smoother. Therefore, after the smoothing step, the error in discriminating can be reduced, and the discrimination rate for the following step can be raised.

After the smoothing step, a classifier is used to tell the speech and the music frames apart. Finally, the frames of the same kind are merged according to the result and the speech and the music segments are then segmented. In the preferred embodiment of the present invention, the classifier is a KNN based classifier to classify the speech and the music types. The signal belongs to the type (the speech or the music) which has the most training data in the nearest k training data in the codebook. In other embodiments of the present invention, other classifiers may also be used, such as a Gaussian mixture model (GMM) classifier, a hidden Markov model (HMM) classifier and a multi-layer perceptron (MLP) classifier.

Figure 8:
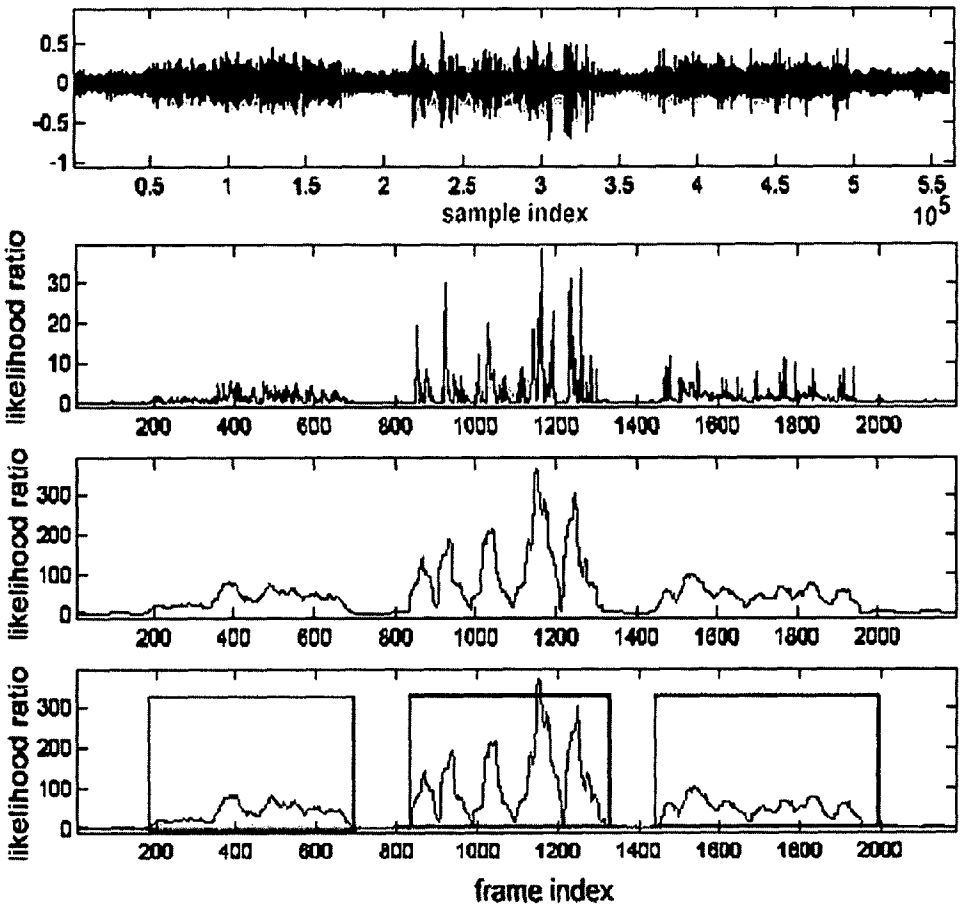
FIG. 8 illustrates an example of the audio signal segmentation algorithm according to the preferred embodiment of the present invention.

Refer to FIG. 8. FIG. 8 illustrates an example of the audio signal segmentation algorithm according to the preferred embodiment of the present invention. The first figure in FIG. 8 is the original input audio signal. The second figure in FIG. 8 is the result after obtaining the likelihood ratio. The third figure in FIG. 8 is the result after the smoothing step, and the fourth figure in FIG. 8 is the result after segmenting the speech and the music segments. From FIG. 8, the speech and the music segments can be obtained from the input audio signal after the audio activity detection step, the audio feature extraction step, the smoothing step and the segmentation step.

According to the aforementioned description, one advantage of the present invention is that the present invention provides an audio signal segmentation algorithm suitable to be used in low SNR environments which works well in practical noisy environments.

According to the aforementioned description, another advantage of the present invention is that the present invention provides an audio signal segmentation algorithm which can be integrated into multimedia content analysis applications, multimedia data compression and audio recognition, and can be used in the front of the audio signal processing system to classify the signals and further to let the system discriminate and segment the speech and the audio signals.

According to the aforementioned description, yet another advantage of the present invention is that the present invention provides an audio signal segmentation algorithm which can be used as an IP to be supplied to multimedia system chips.

As is understood by a person skilled in the art, the foregoing preferred embodiments of the present invention are illustrative of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. An audio signal segmentation algorithm comprising:

providing an audio signal;

applying an audio activity detection (AAD) step to divide the audio signal into at least one first audio segment and at least one second audio segment, wherein the audio activity detection step further comprises:

dividing the audio signal into a plurality of frames;

applying a frequency transformation step to signals in each of the frames to obtain a plurality of bands in each frame;

performing a likelihood computation step to the bands and a noise parameter to obtain a likelihood ratio therebetween;

performing a comparison step to the likelihood ratio and a noise threshold, if the noise threshold is greater than the likelihood ratio, the bands belonging to a first frame, and if the likelihood ratio is greater than the noise threshold, the bands belonging to a second frame wherein the first frame belongs to the first audio segment and the second frame belongs to the second audio segment; and when a distance between two adjacent second frames is smaller than a predetermined value, combining the two adjacent second frames to compose the second audio segment, performing an audio feature extraction step on the second audio segment to obtain a plurality of audio features of the second audio segment;

applying a smoothing step to the second audio segment after the audio feature extraction step; and discriminating a plurality of speech frames and a plurality of music frames from the second audio segment wherein the speech frames and the music frames compose at least one speech segment and at least one music segment, respectively.

2. The audio signal segmentation algorithm according to claim 1, wherein the frequency transformation step is proceeding a Fourier Transform.

3. The audio signal segmentation algorithm according to claim 1, wherein the noise parameter is a noise variance of Fourier coefficient and is obtained by estimating a variance of a noise segment in the initial part of the audio signal.

4. The audio signal segmentation algorithm according to claim 1, wherein the likelihood computation step and the comparison step are based on the equation:

$$\Lambda = \frac{1}{L}\sum_{k=0}^{L-1}\left\{\frac{|X_k|^2}{\lambda_N(k)} - \log\frac{|X_k|^2}{\lambda_N(k)} - 1\right\} \underset{H_0}{\overset{H_1}{\gtrless}} \eta$$

where $\Lambda$ is the likelihood ratio, L is the number of the bands, $X_k$ denotes the kth Fourier coefficient in one of the frames, $\lambda_k(k)$ is the noise variance of Fourier coefficient and denotes the variance of the kth Fourier coefficient of the noise, $\eta$ is the noise threshold, H0 denotes the result is the first frame, and H1 denotes the result is the second frame.

5. The audio signal segmentation algorithm according to claim 1, wherein the estimation of the noise threshold further comprises:

extracting a noise segment from the initial part of the audio signal;

mixing the noise segment with one of a plurality of noiseless speech/music segments to a predetermined signal-to-noise ratio (SNR) to form a mixing audio segment;

applying the audio activity detection step to the mixing audio segment to divide the mixing audio segment into at least one speech segment and at least one music segment by using a first threshold; and judging if the speech segment and the music segment match the noiseless speech/music segment and obtaining a result, if the result is yes, the first threshold being equal to the noise threshold, and if the result is no, adjusting the first threshold and repeating the audio activity detection step and the judging step on the mixing audio segment.

6. The audio signal segmentation algorithm according to claim 5, further comprising:

mixing the noise segment and the other noiseless speech/music segments, respectively, and repeating the audio activity detection step and the judging step to obtain a plurality of thresholds; and comparing the thresholds with the first threshold to choose a smallest value as the noise threshold.

7. The audio signal segmentation algorithm according to claim 1, wherein the audio features are selected from the group consisting of low short time energy rate (LSTER), spectrum flux (SF), likelihood ratio crossing rate (LRCR) and an arbitrary combination thereof.

8. The audio signal segmentation algorithm according to claim 7, wherein the audio feature extraction step extracts the audio feature of the likelihood ratio crossing rate further comprising:

computing a sum of a crossing rate in the waveform of the likelihood ratio compared to a plurality of predetermined thresholds by using the likelihood ratio of each frame, if the sum of the crossing rate is greater than a predetermined value, the likelihood ratio belongs to the speech segment, and if the sum of the crossing rate is smaller than the predetermined value, the likelihood ratio belongs to the music segment.

9. The audio signal segmentation algorithm according to claim 8, wherein one of the predetermined thresholds is one third the mean of the likelihood ratio, and another one of the predetermined thresholds is one ninth the mean of the likelihood ratio.

10. The audio signal segmentation algorithm according to claim 1, wherein the smoothing step further comprises performing a convolution process to the second audio segment after the audio feature extraction step and a window.

11. The audio signal segmentation algorithm according to claim 10, wherein the window is a rectangular window.

12. The audio signal segmentation algorithm according to claim 1, wherein the step of discriminating the speech frames and the music frames from the second audio segment is based on a classifier, and the classifier is selected from the group consisting of a K-nearest neighbor (KNN) classifier, a Gaussian mixture model (GMM) classifier, a hidden Markov model (HMM) classifier and a multi-layer perceptron (MLP) classifier.

13. The audio signal segmentation algorithm according to claim 1, further comprising combining the speech frames and the music frames, respectively, to form the speech segment and the music segment after the step of discriminating the speech frames and the music frames from the second audio segment.

14. The audio signal segmentation algorithm according to claim 1, further comprising segmenting the speech segment and the music segment from the second audio segment.

15. The audio signal segmentation algorithm according to claim 1, wherein the first audio segment is a noise segment.

16. The audio signal segmentation algorithm according to claim 1, wherein the audio features are extracted by a frame with fixed length in the audio feature extraction step.

17. The audio signal segmentation algorithm according to claim 16, wherein the fixed length is one second.

* * * * *